US007681765B2

(12) United States Patent
Muderlak

(10) Patent No.: US 7,681,765 B2
(45) Date of Patent: Mar. 23, 2010

(54) DISPENSER WITH DRAW-BACK MECHANISM

(75) Inventor: Kenneth J. Muderlak, Milwaukee, WI (US)

(73) Assignee: Technical Concepts, LLC, Mundelein, IL (US)

( * ) Notice: Subject to any disclaimer, the term of this patent is extended or adjusted under 35 U.S.C. 154(b) by 0 days.

(21) Appl. No.: 12/256,763

(22) Filed: Oct. 23, 2008

(65) Prior Publication Data

US 2009/0101679 A1 Apr. 23, 2009

Related U.S. Application Data

(60) Provisional application No. 60/981,995, filed on Oct. 23, 2007.

(51) Int. Cl.
*B65D 5/72* (2006.01)

(52) U.S. Cl. ..... 222/571; 222/1; 222/108; 222/333; 222/375; 222/383.1; 222/464.3; 239/119

(58) Field of Classification Search ..... 222/375, 222/571, 383.1, 108, 333, 1, 321.7, 464.3; 239/333, 119

See application file for complete search history.

(56) References Cited

U.S. PATENT DOCUMENTS 2,772,116 A 11/1956 Dobkin
5,836,482 A 11/1998 Ophardt et al.
5,947,340 A 9/1999 Arnold et al.
6,467,651 B1 * 10/2002 Muderlak et al. ..... 222/52
6,698,629 B2 3/2004 Taylor-McCune
6,929,150 B2 * 8/2005 Muderlak et al. ..... 222/1
2007/0023454 A1 2/2007 Ophardt

OTHER PUBLICATIONS

Patent Cooperation Treaty, International Search Report, Dec. 29, 2008.

* cited by examiner

*Primary Examiner*—Frederick C. Nicolas
(74) *Attorney, Agent, or Firm*—Dennis J. Williamson; Moore & Van Allen, PLLC

(57) ABSTRACT

This patent discloses tools, methods and systems for dispensing soap. The tools, methods and systems include a draw-back chamber constructed around and in line with the fluid path between a spout assembly for delivering soap to a user and a pump mechanism for supplying the soap. The draw-back chamber contains port openings into the fluid path. When the pump mechanism is actuated to dispense soap, the draw back chamber is collapsed and soap within it is dispensed with the main dose of soap supplied by the pump mechanism. When the pump mechanism is allowed to return to its extended rest state, the draw-back chamber expands, drawing soap into it through the port opening to prevent soap from hanging and dripping at the end of the dispensing tube.

22 Claims, 13 Drawing Sheets

DISPENSER WITH DRAW-BACK MECHANISM

CROSS REFERENCE TO RELATED APPLICATIONS

This application claims the benefit of priority under 35 U.S.C. §119 (e) to the filing date of U.S. Provisional Patent Application No. 60/981,995 filed on Oct. 23, 2007, which is incorporated herein by reference in its entirety.

TECHNICAL FIELD

The present invention relates to soap dispensers. More specifically, the present invention relates to counter mounted soap dispensers having a draw-back mechanism for preventing dripping of soap between uses.

BACKGROUND

Users of modern public washroom facilities increasingly desire that each of the fixtures in the washroom operate automatically without being touched by the user's hands. This is important in view of increased user awareness of the degree to which germs and bacteria may be transmitted from one person to another in a public washroom environment. Today, it is not uncommon to find public washrooms with automatic, hands-free operated toilet and urinal units, hand washing faucets, soap dispensers, hand dryers and door opening mechanisms. This automation allows the user to avoid touching any of the fixtures in the facility, and therefore lessens the opportunity for the transmission of disease carrying germs or bacteria resulting from manual contact with the fixtures in the washroom.

It is known to provide a counter-mounted soap dispensers in public washrooms to dispense liquid or foam soap automatically in response to sensing the presence of a user. However, these counter-mounted dispensers may allow soap to drip out of the dispenser after a use. This dripping creates an unappealing and messy environment and discourages the use of the dispenser. Thus, it is desirable to provide an improved means that prevents leakage or dripping of excess soap.

These and other objectives, advantages, and features of the present invention will become apparent from the following description and claims, taken in conjunction with the accompanying drawings.

BRIEF SUMMARY

This patent discloses tools, methods and systems for dispensing soap. The tools, methods and systems include a draw-back chamber constructed around and in line with the fluid path between a spout assembly for delivering soap to a user and a pump mechanism for supplying the soap. The draw-back chamber contains port openings into the fluid path. When the pump mechanism is actuated to dispense soap, the draw back chamber is collapsed and soap within it is dispensed with the main dose of soap supplied by the pump mechanism. When the pump mechanism is allowed to return to its extended rest state, the draw-back chamber expands, drawing soap into it through the port opening to prevent soap from hanging and dripping at the end of the dispensing tube.

Additional features and advantages of the present invention are described in, and will be apparent from, the following Detailed Description and the figures.

DETAILED DESCRIPTION

Figure 1:
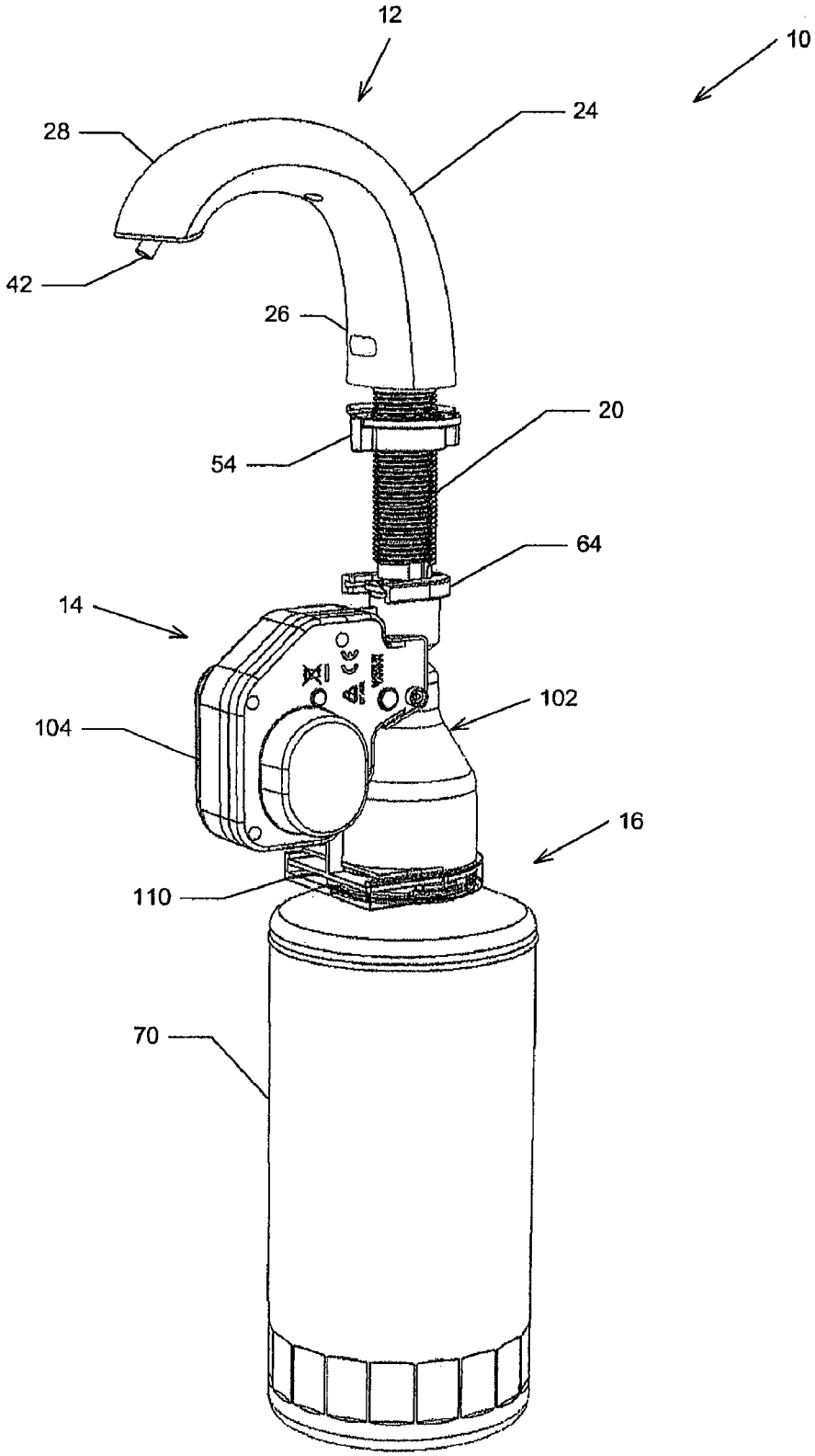
FIG. 1 is a perspective view of an automatic foam soap dispensing system in accordance with an embodiment of the present invention.
Figure 2:
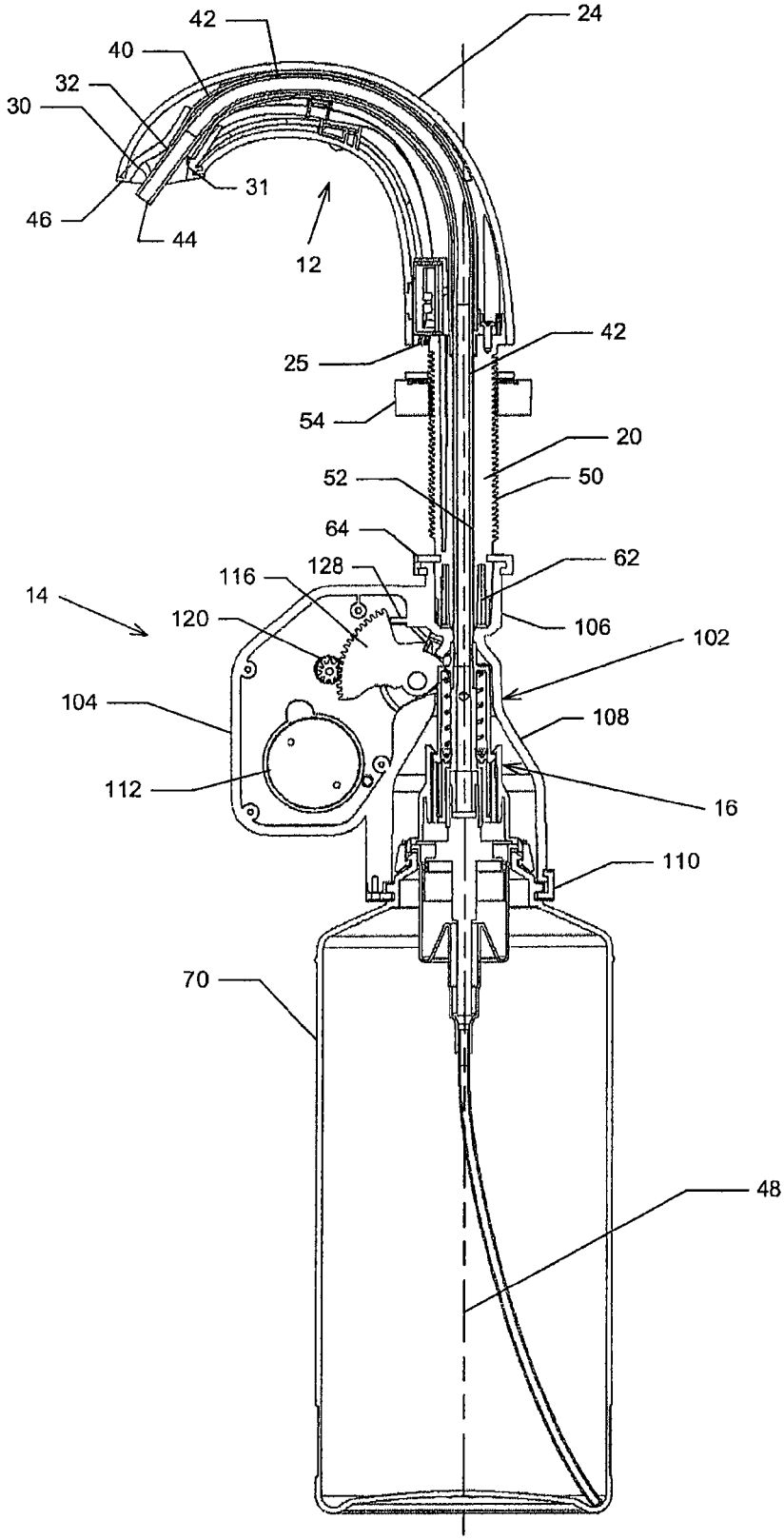
FIG. 2 is a cross-sectional elevation view of the system of FIG. 1.

Referring to FIGS. 1 and 2, an automatic foam soap dispensing system 10 is disclosed in accordance with one embodiment of the present invention. However, it will be understood that other fluid products, for example cosmetics products, personal care products, and cleaning products, can also be dispensed using the an automatic foam soap dispensing system 10 without departing from the scope of the invention. Further, it will be understood that the automatic foam soap dispensing system 10 is suited for dispensing other types of non-foaming products, such as sprays or lotions.

The foam soap dispensing system 10 generally includes three major assemblies: a spout assembly 12 to deliver foam soap to a user, a motor housing assembly 14 to actuate and control the operation of the foam soap dispensing system 10, and a pump and draw-back assembly 16 to create foam soap and to prevent soap dripping from the spout assembly 12 between uses.

The Spout Assembly

Referring now to the spout assembly 12, an exemplary spout assembly is found in U.S. Pat. No. 6,929,150 issued Aug. 16, 2005 to Kenneth J. Muderlak and Rocky Hsieh and assigned to Technical Concepts, LLC, the disclosure of which is incorporated herein by reference in its entirety. In the embodiment of FIGS. 1 and 2, the spout assembly 12 includes a support shaft 20 which may extend through an aperture disposed through a countertop. The support shaft 20 may be hollow and threaded. The support shaft 20 is fixed to, or may form a part of, a rigid spout 24. The rigid spout 24 includes a base 25 abutting the countertop, an upwardly extending indicator housing portion 26, and a curved dispensing portion 28. The outer end of the curved dispensing portion 28 includes an indented outlet 30 having a spout opening 32 therein to aid in dispensing foam soap.

Figure 3:
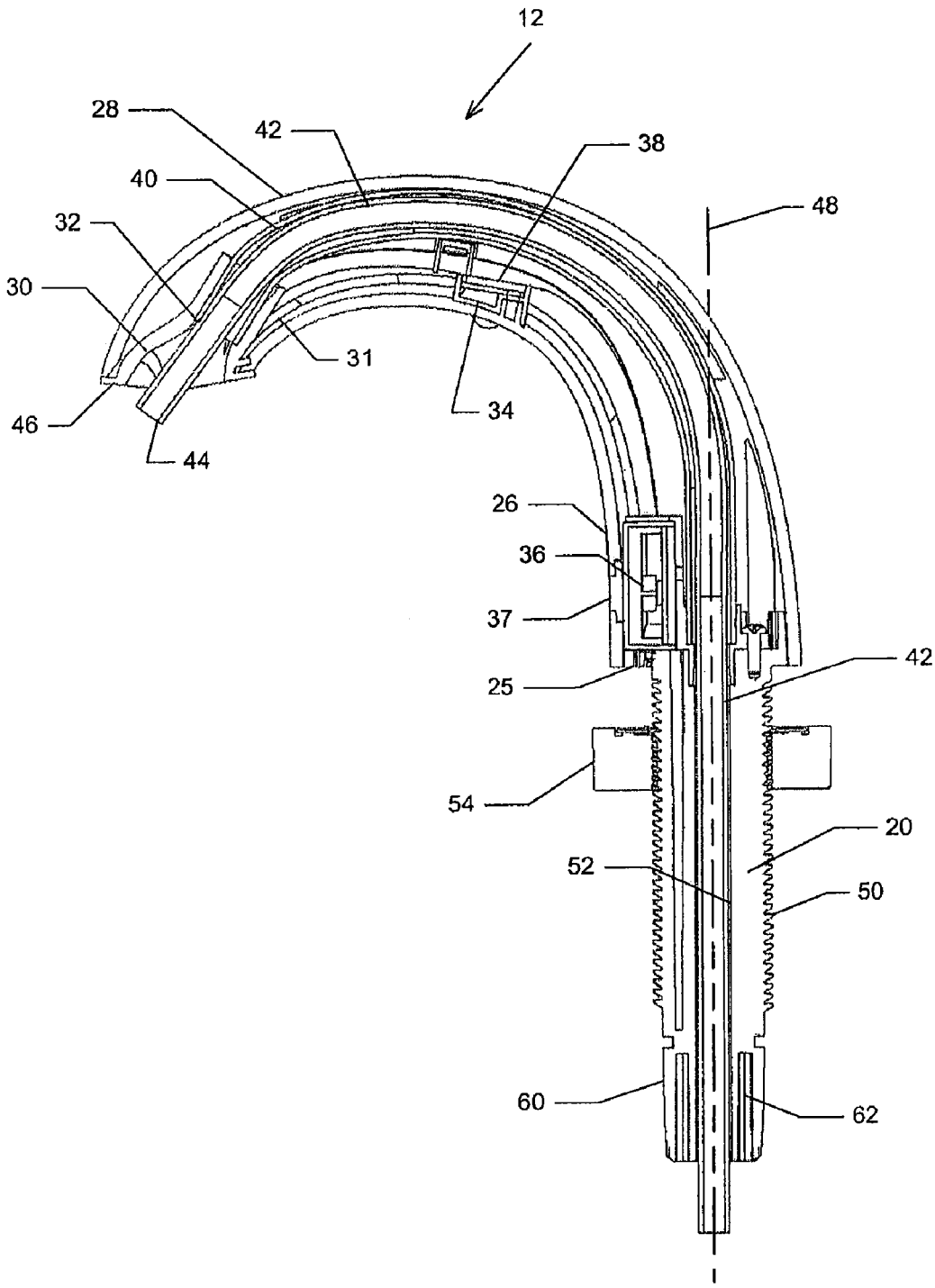
FIG. 3 is a cross-sectional elevation view of the spout assembly of the system of FIG. 1.

As shown in FIG. 3, the curved dispensing portion 28 of the rigid spout 24 includes an opening 34 in which an electric eye sensor or assembly 38 is mounted in the curved dispensing portion 28. Individual sensors, such as infrared (IR) emitter and an IR detector, may be included as part of electric eye assembly 38 to detect the presence of a user's hands beneath the spout opening 32, and, in response, to activate a switch to initiate operation of foam soap dispensing system 10. Indicator lights 36, for example, light emitting diodes (LEDs), may also be disposed behind a transparent lens 37 in the indicator housing portion 26 to signal a "battery low" and/or soap reservoir "empty" condition.

As shown in FIGS. 2 and 3, the rigid spout 24 includes a curved internal passageway 40 that extends from the base 25 through the spout 24 to connect with the spout opening 32. An elongated dispensing tube 42 is disposed in the passageway 40. When the pump and draw-back assembly 16 is attached to the motor housing assembly 14, the tube end 44 of the elongated dispensing tube 42 will move reciprocally in the passageway 40 upon actuation of the pump and draw-back assembly 16, as will be explained. The inner surface of the internal passageway 40 is composed of a smooth material to provide a substantially frictionless path for movement of the elongated dispensing tube 42 in the passageway 40 during installation and removal of the pump and draw-back assembly 16 and during each actuation of the foam soap dispensing system 10. In addition, the radius of curvature of the internal passageway 40 is configured to allow the elongated dispensing tube 42 to slidably and smoothly move inside the passageway 40. By way of example, in the present embodiment, the radius of curvature of the passageway 40 is approximately two inches. The dispensing tube 42 is made of LDPE (low density polyethylene), or other suitable material which will not react with the chemicals in the soap, and which provides a smooth outer surface to accommodate almost frictionless movement of the dispensing tube 42 in the passageway 40.

The indented outlet 30 may include an indented portion 31 that is set back from a spout tip 46 of spout 24. The indented portion 31 provides a shield around the tube end 44 of the dispensing tube 42. The indented portion 31 may prevent the tube end 44 from being viewed by a user when the tube end 44 of the dispensing tube 42 extends beyond the spout opening 32.

The passageway 40 is centrally disposed in the spout 24 throughout the length of the passageway 40. As seen in FIG. 2, the lower end of the passageway 40 is disposed along a central or longitudinal axis 48 of a liquid soap container 70. Thus, when the dispensing tube 42 and the container 70 are rotated during installation of a full container 70, the dispensing tube 42 rotates in the passageway 40 about the axis 48 throughout the length of the passageway 40. Since the dispensing tube 42 is centrally located about the axis 48, and is centrally located in the passageway 40, the container 70 is able to be rotated to be properly positioned relative to the motor housing assembly 14 during installation and removal of the container 70.

Referring to FIGS. 2 and 3, the support shaft 20 has external threads 50 and an internal guide passageway 52 centered around the axis 48 through which elongated dispensing tube 42 extends. The guide passageway 52 is configured to allow the dispensing tube 42 to rotate therein during installation and removal of the container 70 and to move reciprocally therein in response to the actuation of the pump and draw-back assembly 16. The external threads 50 are formed in an outer wall of the support shaft 20 substantially along the length thereof. A manually rotatable nut 54 is also provided, including mating internal threads (not shown) which engage the external threads 50 in a known manner, permitting the nut 54 to be rotated and moved upward to engage the underside of a countertop and to secure the support shaft 20 and the spout 24 against movement relative to the countertop.

Extending from the lower portion of the support shaft 20 is a cylindrical attachment shaft 60. The attachment shaft includes a central opening through which the dispensing tube 42 extends along the axis 48. The attachment shaft 60 also include a plurality of circumferentially disposed splines 62 adapted to mate with a plurality of grooves (not shown) circumferentially disposed in a hollow upper interior portion 106 of the pump housing 102 of the motor housing assembly 14 so as to provide for the attachment of motor housing assembly 14 to the support shaft 20. This arrangement permits the internal guide passageway 52 of the support shaft 20 to align with the upper interior portion 106 of the motor housing assembly 14. In the present embodiment, the splines 62 are disposed at thirty degree intervals.

Upon moving the motor housing assembly 14 into engagement with the attachment shaft 60, the circumferential distance between adjacent splines 62 and grooves disposed in the upper interior portion 106 of the motor housing assembly 14 allows the motor housing assembly 14 to be rotated in thirty degree increments, allowing placement of the motor housing assembly 14 to avoid interfering with the underside of the sink bowl and other plumbing or structural elements located under the countertop. This also allows the motor housing assembly 14 to be positioned for ease of access in case a need to service the foam soap dispensing system 10 arises.

The Motor Housing Assembly

As noted above, the motor housing assembly 14 provides the driving force to actuate the pump and draw-back assembly 16 for producing foam soap when it is installed on the support shaft 20. The motor housing assembly 14 may be removably attached to the lower end of support shaft 20 by a shank clip 64, as shown in FIGS. 1 and 2. The shank clip 64 may be generally U-shaped and adapted to engage a circumferentially indented shaft groove 68 formed on the lower portion of the support shaft 20 so as to secure the motor housing assembly 14 to the support shaft 20. A suitable shank clip 64 that provides easy attachment and detachment of the motor housing assembly 14 to the support shaft 20 is found, for example, in U.S. Pat. No. 6,929,150.

The motor housing assembly 14 includes a pump housing 102 and a motor and actuator mechanism housing 104, as shown in FIGS. 1 and 2. The pump housing 102 includes a hollow upper interior portion 106 that receives the attachment shaft 60, as described above. The pump housing 102 also includes a hollow lower interior portion 108 centered along the axis 48 through which foam soap may be conveyed from the pump assembly 16 to the spout 24, as will be explained. A reservoir assembly mounting clip 110 is located at the bottom of pump housing 102 to removably mount the reservoir and pump assembly 16 to the pump housing 102. In particular, the mounting clip 110 is adapted to releasably and securely hold the liquid soap container 70 to the lower end of the pump housing 102. A suitable mounting clip 110 is found, for example, in U.S. Pat. No. 6,929,150.

Figure 4:
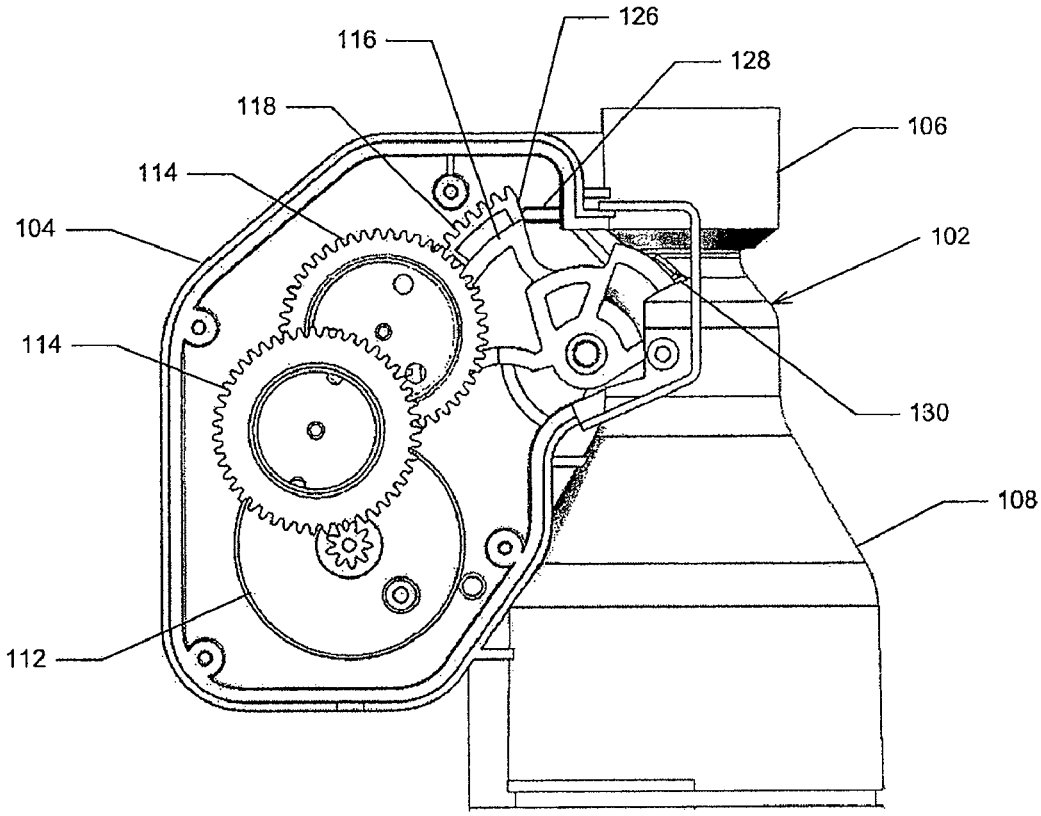
FIG. 4 is a schematic elevation view of the motor housing assembly of the system of FIG. 1.

As may be seen in FIGS. 2 and 4, the motor and actuator mechanism housing 104 may include a motor 112, gear reduction train 114 and pump hammer 116. A switch control circuit (not shown) may be electrically connected to the electric eye assembly 38 and the motor 112 to initiate operation of the foam soap dispensing system 10 and control the operation of the motor 112 when the electric eye assembly 38 detects the presence of a user. A suitable switch control circuit is found in, for example, U.S. Pat. No. 6,929,150. It will be understood by one of skill in the art that the foam soap dispensing system 10 may also include a battery pack (not shown) for supplying power to the motor 112 and the electronic components of electric eye assembly 38, and that the battery pack may be permanently or removably connected to the motor and actuator mechanism housing 104.

Figure 5:
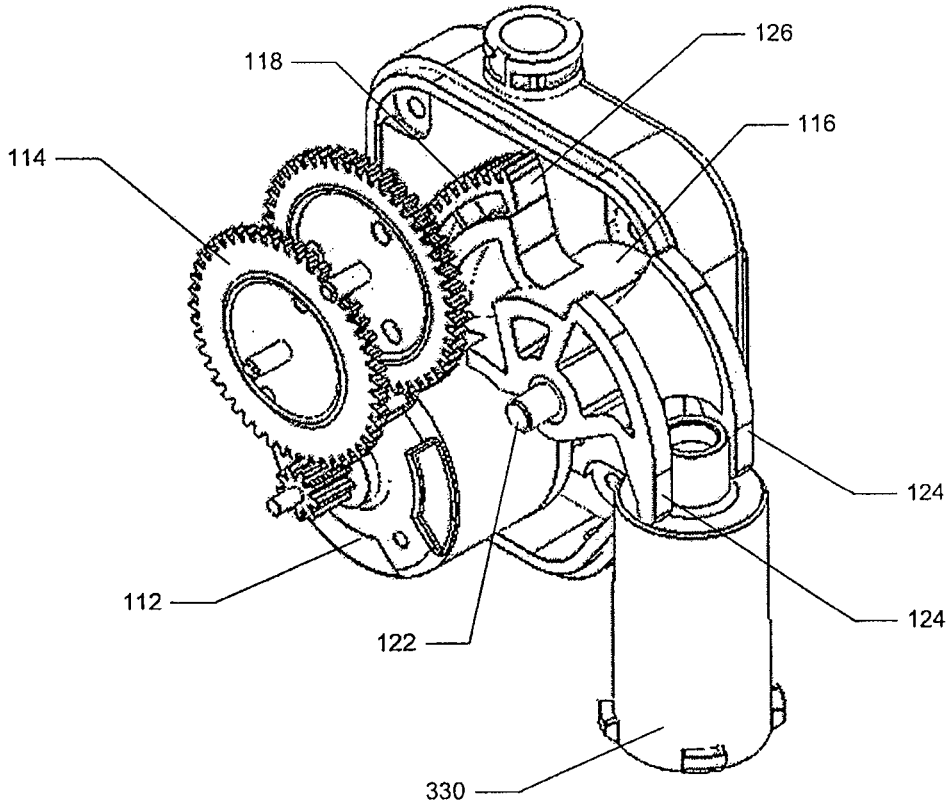
FIG. 5 is a schematic perspective view showing the contact in an actuated position between the pump hammer of the motor housing assembly and the pump actuator of the pump and draw-back assembly of the system of FIG. 1.

The gear reduction train 114 is mounted for rotation in the housing 104 and operatively connects the output of the motor 112 to the pump hammer 116. The pump hammer 116 includes an actuate gear portion 118 which meshes with a spur gear 120, which in turn is driven by the motor 112 through the gear reduction train 114. The pump hammer 116 is mounted on a pin 122 for rotation through a small arc relative to the housing 104, as shown in FIG. 5. At an end of the pump hammer 116 may be a pair of actuator arms 124 which rotate as pump hammer 116 rotates through a small arc. The pump hammer 116 also includes a flat face 126 adapted to engage a hammer kick back stop 128, which may be rigidly, but adjustably, mounted on the interior of housing 104. Alternatively, the hammer kick back stop 128 may be adjustably mounted on the housing 104. The pump housing 102 is provided with an opening 130 in one sidewall to allow selective contact between pump hammer 116 and a pump actuator 330 of the pump and draw-back assembly 16, as will be explained.

The Pump and Draw-Back Assembly

Reference now will be made to the pump and draw-back assembly 16, as shown in FIGS. 7-13. The pump and draw-back assembly 16 may include the dispensing tube 42, a pump mechanism 200, and a draw-back mechanism 300 connected between the dispensing tube 42 and the pump mechanism 200 to draw in foam soap from the dispensing tube 42 after a dose of foam soap has been dispensed so as to prevent soap from dripping from the end 44 of the dispensing tube 42 between uses.

Figure 9:
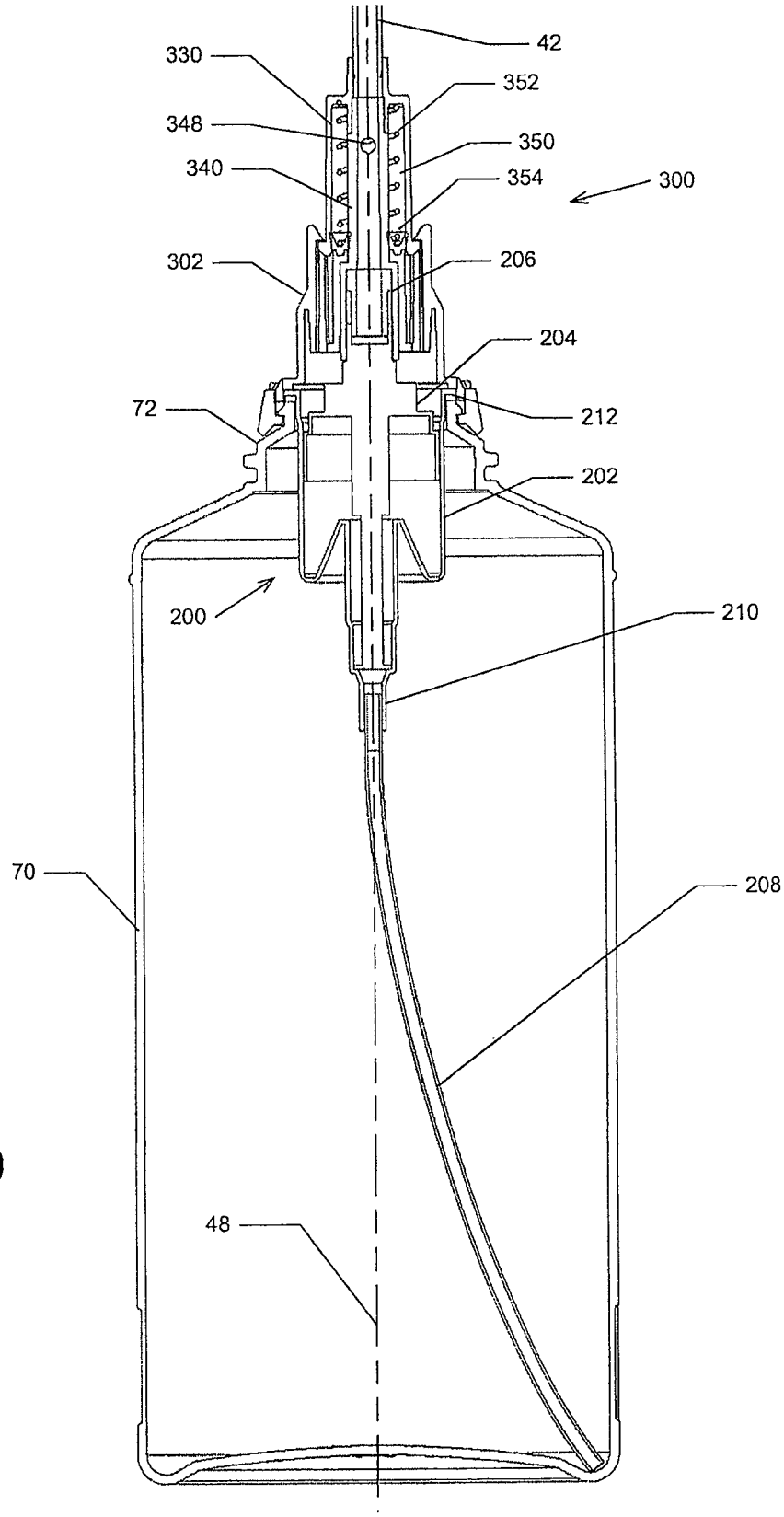
FIG. 9 is a cross-sectional elevation view of the draw-back assembly of the system of FIG. 1 attached to a liquid soap container in a non-actuated position.

Preferably, the dispensing tube 42, the pump mechanism 200 and the draw-back mechanism 300 are all aligned on a common centerline along the axis 48, as shown in FIG. 9, to provide ease of installation of the pump and draw-back assembly 16. Thus, when the pump and draw-back assembly 16 is rotated during installation and removal from the motor housing assembly 14, all of the elements comprising the pump and draw-back assembly 16 can rotate smoothly and substantially frictionless in their respective housings and passageways. In addition, the single centerline construction of the pump and draw-back assembly 16 allows the draw-back mechanism 300 to be used with a commonly available pump mechanism 200, without the need for any specially constructed or located pump assemblies. This obviously reduces the cost of the pump and draw-back assembly 16. Further, the pump and draw-back assembly 16 may form a unitary assembly that may be discarded when the container 70 has been emptied of liquid soap. Therefore, a replacement pump and draw-back assembly 16 may be furnished with each refill container 70 installed in the dispenser 10.

Figure 7:
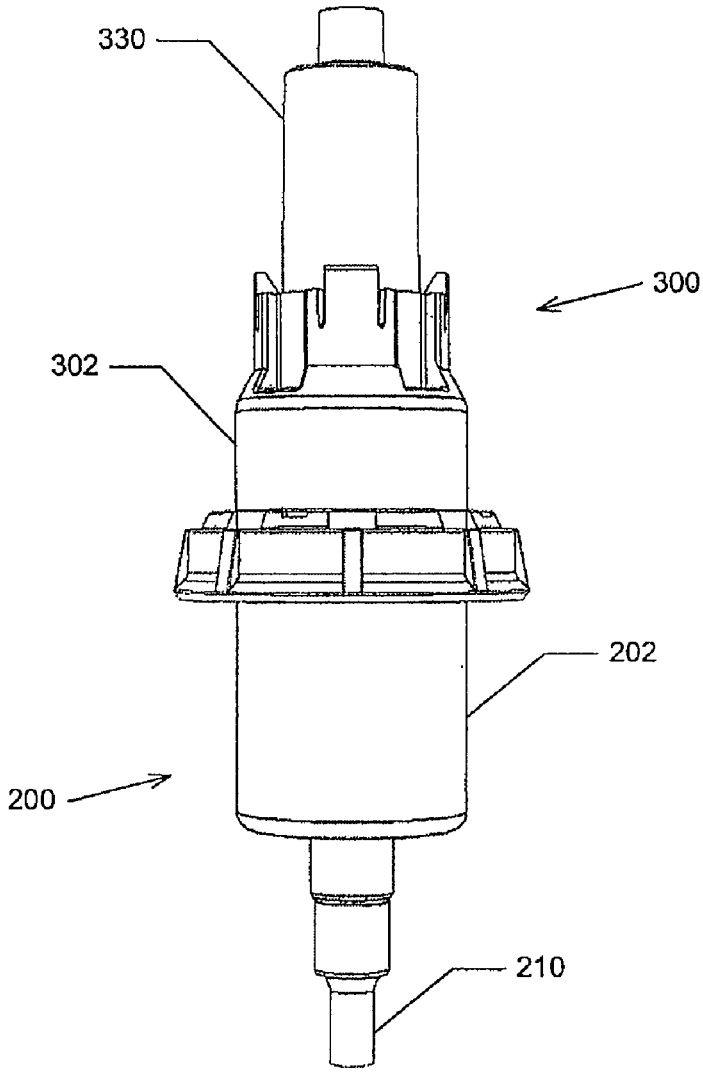
FIG. 7 is a perspective view of the draw-back assembly of the system of FIG. 1.
Figure 8:
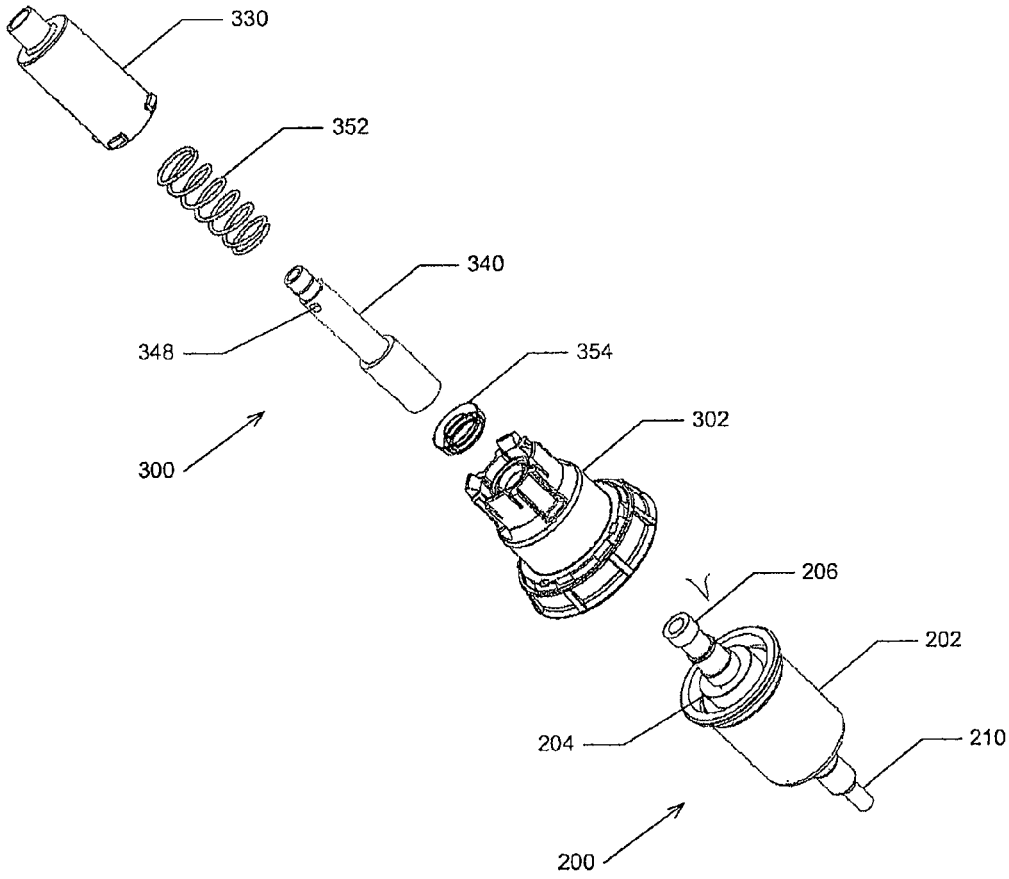
FIG. 8 is an exploded view of the draw-back assembly of the system of FIG. 1.

The draw-back mechanism 300 is disposed in the hollow interior portion 108 of the pump housing 102, as shown in FIG. 2, and is centered around the axis 48. As shown in FIGS. 7-8, the draw-back mechanism 300 includes a cap member 302, a pump actuator 330, bayonette guide 340, a compression spring 352, and a seal 354, which are disposed around the axis 48 concentric with each other.

Figure 10:
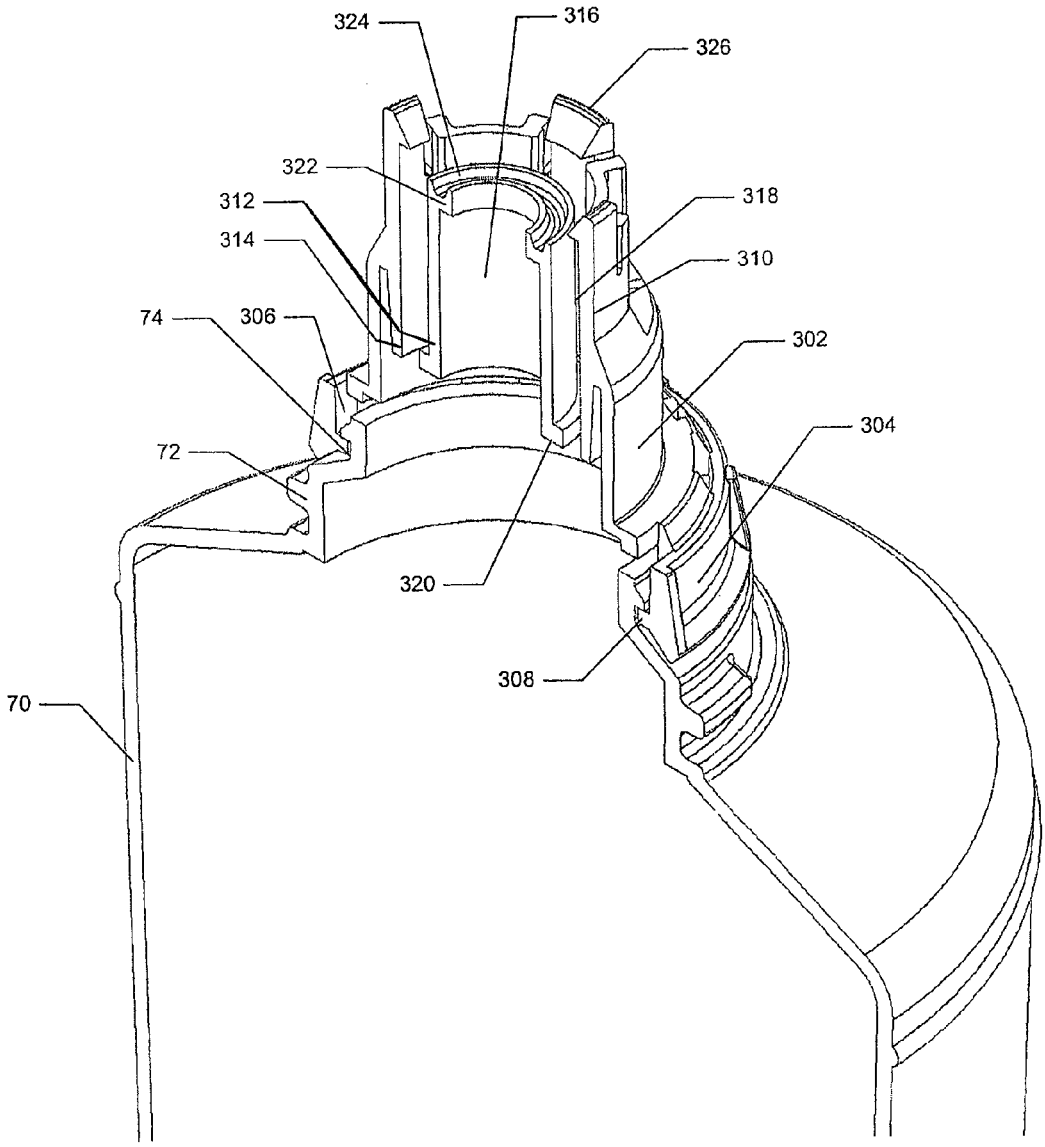
FIG. 10 is a cross-sectional perspective view of the cap member of the draw-back assembly of the system of FIG. 1 attached to a liquid soap container.

Referring to FIGS. 9 and 10, the cap member 302 is secured over the neck 72 of the container 70. The neck 72 of the container 70 is received in a shallow cavity 306 defined by the lower end of the base 304 of the cap member 302. A protruding edge 308 is formed circumferentially around the interior surface of the cavity 306 so as to mate with a neck groove 74 circumscribing the neck 72 of the container 70 for securing the cap member 302 to the container 70.

The body 310 of the cap member 302 has a double wall construction, including a pair of cylindrical inner and outer walls 312, 314 that define a cylindrical central opening 316 and an annular opening 318 concentric with the central opening 316. The inner wall 312 has a circumferential stop lip 320 extending radially outward therefrom at its lower end and an annular seat flange 322 extending radially inward therefrom at its upper end. The annular seat flange 322 defines a seat portion 324. The outer wall 314 is concentric with the inner wall 312 so as to define the annular opening 318 therebetween. The upper end of the outer wall 314 extends out past the upper end of the inner wall 312. A plurality of spaced apart stop members 326 extending radially inward are formed around the perimeter of the upper end of the outer wall 314.

Figure 11:
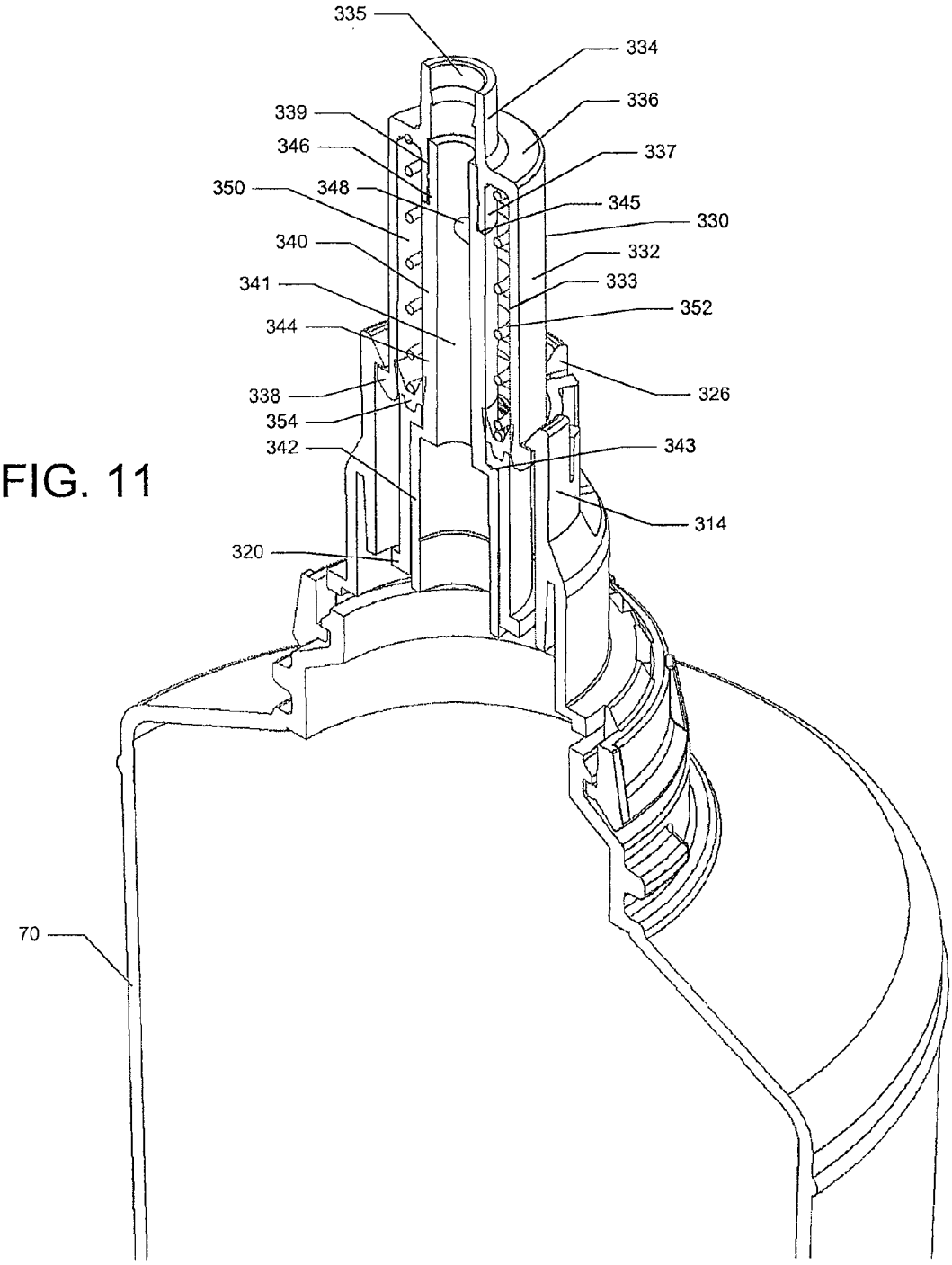
FIG. 11 is a cross-sectional perspective view of the draw-back assembly of the system of FIG. 1 attached to a liquid soap container in a non-actuated position.

Referring to FIGS. 9 and 11, the draw-back assembly also includes a pump actuator 330. The pump actuator 330 has a cylindrical body 332 and a reduced diameter neck portion 334 that is concentric with the cylindrical body 332. The cylindrical body 332 and the reduced diameter neck portion 334 are joined by an annular actuator flange 336 extending radially inward from the cylindrical body 332 at its upper end.

The cylindrical body 332 defines an interior cavity 333. An internal cylindrical projection 337 formed on the annular actuator flange 336 extends axially therefrom into the interior cavity 333 and defines a recess 339 therein. The body 332 is mounted over the cap member 302 concentric with the inner wall 312 of the cap member 302. A guide flange 338 disposed about the lower end of the body of the pump actuator 330 is slidably received within the annular opening 318 of the cap member 302. In this way, the pump actuator 330 is moveably connected to the cap member 302.

The pump actuator 330 moves downward when pump mechanism 200 is actuated, as will be explained. Downward movement of the pump actuator 330 within the annular opening 318 of the cap member 302 is limited by the abutment of the guide flange 338 against the circumferential stop lip 320 of the inner wall 312 of the cap member 302. Upward movement of the pump actuator 330 within the annular opening 318 of the cap member 302 is limited by the abutment of the guide flange 338 against the spaced apart stop members 326 of the outer wall 314 of the cap member 302.

The reduced diameter neck portion 334 defines an axial opening 335 extending therethrough for receiving the elongated dispensing tube 42. Elongated dispensing tube 42 is firmly lodged in cylindrical opening 335 of actuator 330, whereby dispensing tube 42 moves in reciprocal directions within guide passageway 52 along with the movement of actuator 330.

The draw-back mechanism 300 further includes a bayonette guide 340 having a generally cylindrical construction and an axial bore 341 extending therethrough to allow passage of soap from the pump mechanism 200 through the draw-back mechanism 300 and into dispensing tube 42, as will be explained. The bayonette guide 340 includes a cylindrical base portion 342, a cylindrical core portion 344 of reduced diameter joined to the base portion 342 by a first step portion 343, and a cylindrical tip portion 346 of further reduced diameter joined to the core 344 by a second step portion 345.

The tip portion 346 of the bayonette guide 340 is mounted in the recess 339 defined by the cylindrical projection 337 of the pump actuator 330 such that the second step portion 345 abuts the lower end of the cylindrical projection 337 and the core portion 344 is centrally disposed in the interior cavity 333 of the cylindrical body 332 of the pump actuator 330. As a result of this interface between the second step portion 345 and the lower end of the cylindrical projection 337, the pump actuator 330 can drive the bayonette guide 340 downward to actuate the pump mechanism 200, as will be explained.

The core portion 344 the bayonette guide 340 and the cylindrical body 332 of the pump actuator 330 define a dedicated draw-back chamber 350 therebetween to draw back foam soap from the dispensing tube 42 after a dose of foam soap has been dispensed, as will be explained. The draw-back chamber 350 is concentric with the axial bore 341 extending through the bayonette guide 340 and is disposed around and in line with the fluid path between the dispensing tube 42 and the pump mechanism 200. The core portion 344 of the bayonette guide 340 has a pair of ports 348 formed opposite each other in a sidewall thereof. The ports 348 form fluid passageways between the axial bore 341 of the bayonette guide 340 and the draw-back chamber 350.

The bayonette guide 340 is further dimensioned such that, when the pump actuator 330 is mounted over the cap member 302 and is fully retracted with the guide flange 338 in abutment against the spaced apart stop members 326, the first step portion 343 abuts the underside of the annular seat flange 322 of the cap member 302 and the base portion 342 is slidably received in the cylindrical central opening 316 of the cap member 302. The base portion 342 of the bayonette guide 340 is connected to the pump mechanism 200 so as actuate the pump mechanism 200, as will be explained.

The draw-back assembly also includes a seal 354 seated in the seat portion 324 defined by the annular seat flange 322 of the cap member 302 and a compression spring 352 mounted over the core and tip portions 344, 346 of the bayonette guide 340. One end of the spring 352 presses against the underside of the actuator flange 336. The other end of the spring 352 presses against the seal 354. In this way, the spring 352 biases the pump actuator 330 away from the cap member 302 and the neck 72 of the container 70. When the spring 352 is unloaded and/or fully extended in its uncompressed state, the pump actuator 330 is in its fully retracted and/or non-actuated position with the guide flange 338 in abutment against the spaced apart stop members 326.

The pump mechanism 200 is configured to deliver a predetermined dosage of foam soap from tube end 44 of dispensing tube 42 upon each actuation of the motor 112. The pump mechanism 200 may include a standard, self-priming pump as is known in the art for creating foam soap from liquid soap without the use of gas propellants. An example of such a foam pump is found in a commercial foam pump supplied by Rexam Airspray Inc. of Pompano Beach, Fla., USA and identified as Model F2L9. Preferably, the pump mechanism 200 generally includes a pump chamber 202, a pump piston 204 slidably disposed in the pump chamber 202, and a hollow nozzle insert 206 securely attached to the upper end of the pump piston and adapted to provide a sealed, internal fluid passageway between the pump mechanism 200 to the draw-back mechanism 300, as shown in FIGS. 8 and 9. Also, the lower end of the pump mechanism 200 may include a cylindrical boss 210 having a hollow central portion, into which a suction tube 208 is inserted. The suction 208 extends downward from boss 210 to substantially the bottom of the liquid soap container 70, leaving a space to allow soap to be conveyed from the bottom of the container 70 into tube 208.

The container 70 includes neck portion 72 having an opening therein centered around the axis 48 through which the pump mechanism 200 is inserted. The pump mechanism 200 is mounted to the neck 72 of the container 70 in such a manner that soap can only flow to the draw-back mechanism 300 through the pump mechanism 200. In the present embodiment, the upper end of the pump chamber 202 includes a protruding, circular outer edge 212 that rests on the upper end surface of the neck 72 of the container 70. Upon mounting the cap member 302 of the draw-back mechanism 300 over the neck 72 of the container 70, the outer edge 212 of the pump chamber 202 is clamped between the cap member 302 and the neck 72 of the container 70.

When the pump mechanism 200 is mounted to the neck 72 of the container 70, the pump chamber 202, the pump piston 204 and the hollow nozzle insert 206 are centered around the axis 48 and are concentric with the bayonette guide 340 of the draw-back mechanism 300. The nozzle insert 206 is received in the axial bore 341 of the base portion 342 of the bayonette guide 340 in abutment against the first step portion 343 joining the base portion 342 and the cylindrical core portion 344. Further, the pump piston 204 may be secured to the base portion 342 of the bayonette guide 340 in a known manner. For example, the base portion 342 may have a groove circumferentially disposed within the axial bore 341 so as to firmly engage a circumferential thread disposed on the outer surface of the pump piston 204.

The pump mechanism 200 may be actuated by pushing the nozzle insert 206 inwardly toward the pump chamber 202. During the compression stroke, the nozzle insert 206 drives the pump piston 204 into the pump chamber 202 so as to create foam soap by mixing liquid soap and air and to pump the foam soap out through the nozzle insert 206. The pump mechanism 200 is spring biased so as to return to its rest state when the nozzle insert 206 is released. During the return stroke, the pump mechanism 200 draws in ambient air from the outside and liquid soap from the container 70 via a suction tube 208. It is contemplated that additional pump mechanisms may be used in the invention, having structure and operation that may vary from the pump description set forth above.

As noted above, the motor housing assembly 14 provides the driving force for the operation of pump mechanism 200. When the foam soap dispensing system 10 is fully assembled, the motor 112 rotates the actuator arms 124 of the pump hammer 116 to engage the actuator flange 336 of the pump actuator 330 so as to drive down the pump actuator 330. The pump actuator 330, in turn, drives down nozzle insert 206 to actuate the pump mechanism 200, as explained above.

When the motor 112 is not energized, the pump hammer 116 is in its full kick back position. The actuator arms 124 of the pump hammer 116 may rest on the upper surface of actuator flange 336, which is in its fully retracted and/or non-actuated position. Alternatively, the actuator arms 124 may be disposed a short distance above the upper surface of actuator flange 336. The actuator arms 124 straddle the reduced diameter neck portion 334 of the pump actuator 330, which extends into the open space 172 of the pump hammer 116.

Figure 6:
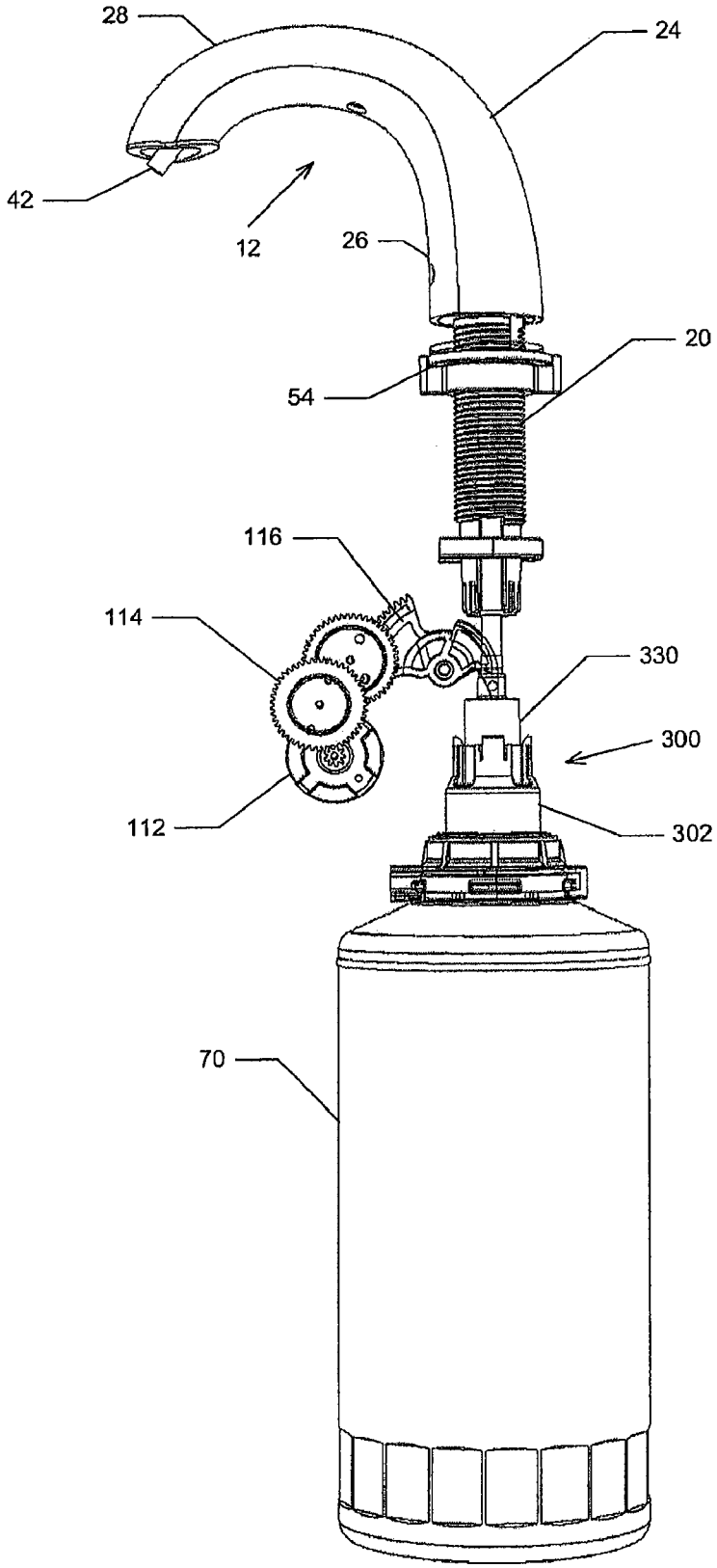
FIG. 6 is another schematic perspective view showing the contact in an actuated position between the pump hammer of the motor housing assembly and the pump actuator of the pump and draw-back assembly of the system of FIG. 1.

Upon actuation of the motor 112, the gear reduction train 114 drives the spur gear 120 which, in turn, rotates the pump hammer 116 clockwise, as shown in FIGS. 5 and 6. As the pump hammer 116 pivots clockwise around pivot pin 122 under the influence of motor 112, the actuator arms 166 engage the actuator flange 336 to drive the pump actuator 330 axially downward into the annular opening 318 of the cap member 302. The pump actuator 330 in turn drives the bayonette guide 340 downward to actuate the pump mechanism 200 by pushing the nozzle insert 206 downwardly toward the pump chamber 202 for dispensing foam soap.

During the down stroke of the pump actuator 330, the seal 354 seated in the seat portion 324 defined by the annular seat flange 322 of the cap member 302 remains stationary. Therefore, as the pump actuator 330 is driven downward into the annular opening 318 of the cap member 302, the draw-back chamber 350 collapses and the compression spring 352 mounted over the bayonette guide 340 is compressed. In this way, residual soap material present in the draw-back chamber 350 may be forced out into the fluid path through the ports 348 between the axial bore 341 of the bayonette guide 340 and the draw-back chamber 350 to be dispensed with the main dose of foam soap being dispensed by the pump mechanism 200 down the dispensing tube 42.

The amount of downward movement of pump actuator 330 generally determines the amount of foam soap that is dispensed from dispensing tube 42 at tube end 44 upon each actuation of the automatic soap dispenser 10. The distance of the downward movement of the pump actuator 330 is controlled by the position of hammer kick back stop 128. To dispense a desired dosage of the foam soap, flat face 126 of pump hammer 116 abuts kick back stop 128, thus halting further clockwise rotation of pump hammer 116.

Referring to FIG. 4, when the flat face 126 of the pump hammer 116 abuts hammer kick back stop 128, the motor 112 stalls and the current through the motor 112 increases. The increase in current through the stalled motor 112 is detected by circuitry (not shown), and the motor 112 is shut off, thus preventing the delivery of torque by the motor 112 to the pump hammer 116.

With the motor 112 shut off, the compression spring 352 urges the pump actuator 330 upwardly to its fully retracted and/or non-actuated position, whereby the flange 336 of the pump actuator 330 moves upward to force the pump hammer 116 to rotate counterclockwise back to its start position. Also, the pump is allowed to return to its rest state, whereby an internal spring in the pump mechanism 200 biases the pump piston 204 and the nozzle insert 206 upwardly, thereby urging the bayonette guide 340 to follow the pump actuator 330 until the second step portion 345 abuts the lower end of the cylindrical projection 337 of the cylindrical body 332 and the first step portion 343 abuts the underside of the annular seat flange 322 of the cap member 302. In this way, the draw back chamber 350 expands during the return stroke, thereby creating a vacuum effect and drawing in foam soap from the dispensing tube 42 through the ports 348. As a result, foam soap is prevented from hanging at the end 44 of the dispensing tube 42 and dripping after a dose of foam soap has been dispensed.

Method of Operation

Once properly installed, operation of the foam soap dispensing system 10 is initiated by a user inserting his or her hands under the indented outlet 30 of the spout 24. The electric eye assembly 38 detects the presence of the hands, and sends a signal to actuate the motor 112. The gear reduction train 114 drives the pump hammer 116 in a clockwise direction, as viewed in FIGS. 2 and 6, whereby the actuator arms 124 positively engage the actuator flange 336 of the pump actuator 330 and drive the pump actuator 330 downward a predetermine distance. The downward movement of pump actuator 330 causes elongated dispensing tube 42 to withdraw the same distance into spout 24 and passageway 40. Preferably the tube end 44 of dispensing tube 42 remains outside of the spout opening 32 in spout 24 in the withdrawn position.

Figure 12:
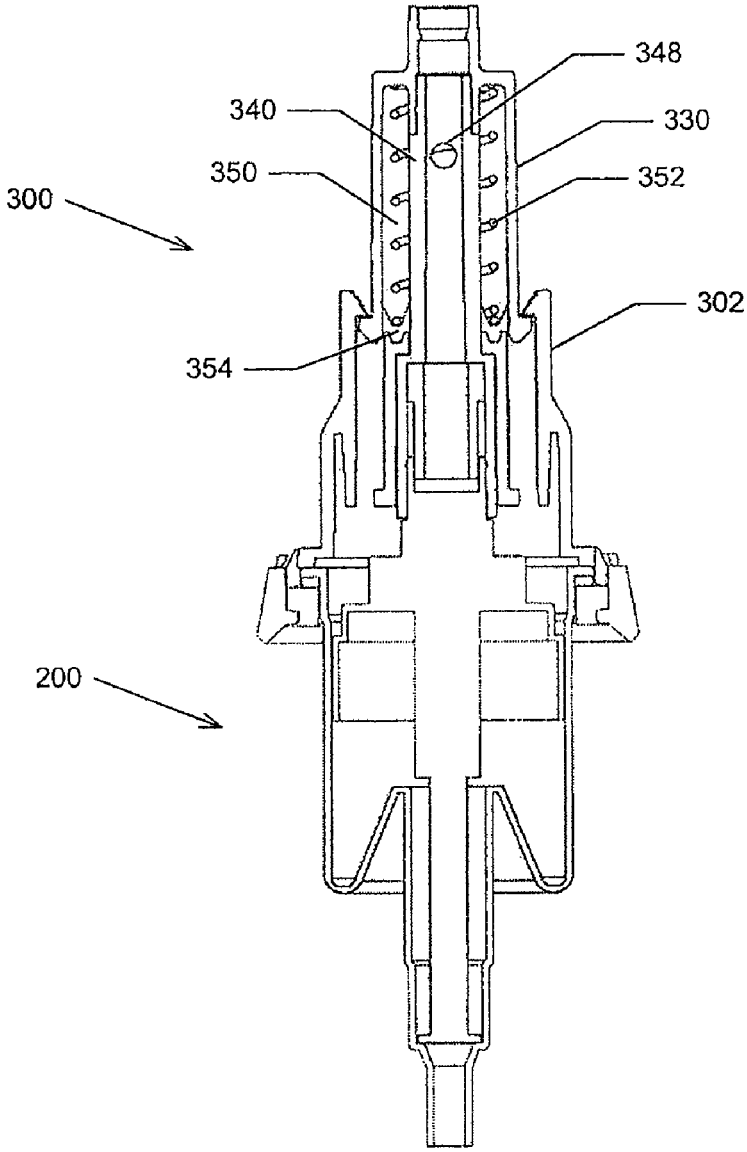
FIG. 12 is a cross-sectional elevation view of the draw-back assembly of the system of FIG. 1 in a non-actuated position.
Figure 13:
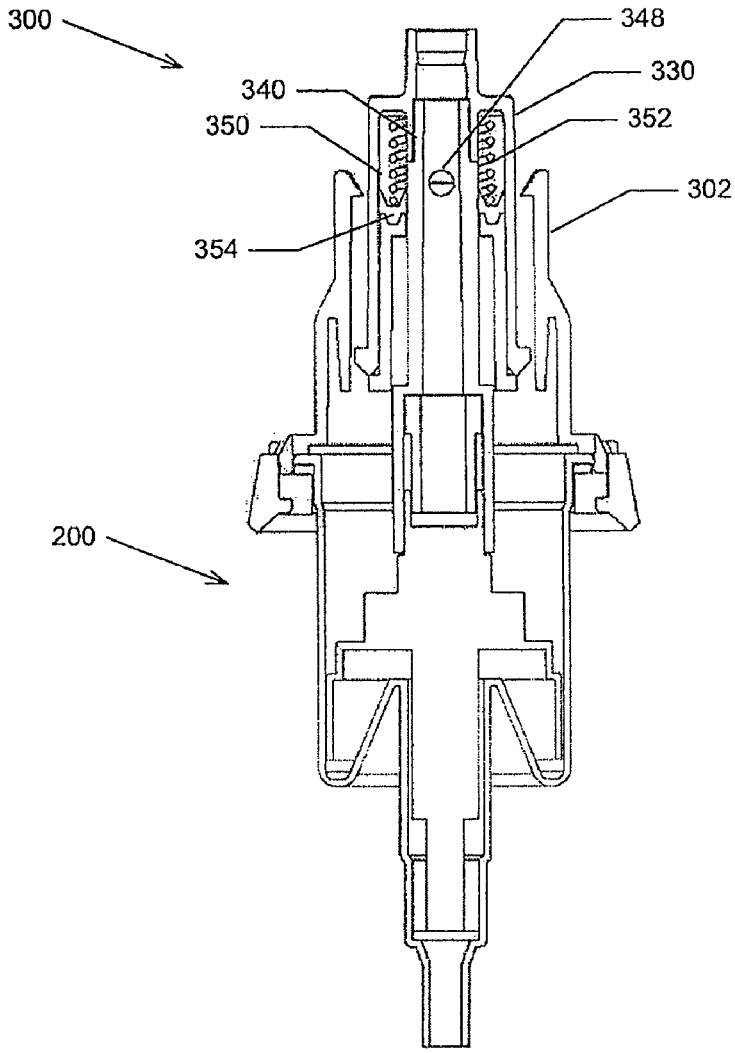
FIG. 13 is a cross-sectional elevation view of the draw-back assembly of the system of FIG. 1 in an actuated position.

As the pump actuator 330 moves downward from its fully retracted and/or non-actuated position (see FIG. 12) under the influence of the pump hammer 116, a measured dosage of foam soap is dispensed from the tube end 44 of the dispensing tube 42, even as the dispensing tube 42 is pulled to its withdrawn position by the pump actuator 330. According to one embodiment, the pump mechanism 200 includes a self-priming pump that is filled with liquid soap prior to actuation of the pump mechanism 200. As pump actuator 330 moves downward, pump mechanism 200 creates foam soap by mixing liquid soap and air and expels the foam soap into the dispensing tube 42 through the bayonette guide 340. Also, the draw-back chamber 350 collapses, as shown in FIG. 13, forcing out residual soap material into the dispensing tube 42 through the ports 348 in the bayonette guide 340 to be dispensed with the main dose of foam soap from the pump mechanism 200.

As pump hammer 116 reaches its limit of clockwise rotation, the motor 112 stalls and is shut off. When the motor 112 is shut off, the pump mechanism 200 is spring biased to return to its rest state. Also, the compression spring 352 urges the pump actuator 330 upwardly to its fully retracted position, forcing the pump hammer 116 to rotate counterclockwise back to its start position and the dispensing tube 42 to move upward back out of the spout opening 32 in the spout 24. As the pump actuator 330 moves upward, the draw-back chamber 350 expands, as shown in FIG. 12, to create a vacuum effect drawing foam soap from the dispensing tube 42 into the draw-back chamber 350 through the ports 348 of the bayonette guide 340. In this way, the draw-back mechanism 330 prevents foam soap hanging and dripping from the tube end 44 of the dispensing tube 42 between uses.

Various embodiments of the invention have been described and illustrated. However, the description and illustrations are by way of example only. Other embodiments and implementations are possible within the scope of the invention and will be apparent to those of ordinary skill in the art. Therefore, the invention is not limited to the specific details of the representative embodiments, and illustrated examples in this description. Accordingly, the invention is not to be restricted except as necessitated by the accompanying claims and their equivalents.

The invention claimed is:

1. A dispensing system for dispensing a fluid comprising:

a dispensing tube;

a pump mechanism for delivering a fluid from a container;

a pump actuator connected to the container for movement between a first position and a second position;

a bayonette guide mounted for movement with said pump actuator and defining a bore extending through said bayonette guide to allow passage of the fluid from the pump mechanism to said dispensing tube;

a draw back chamber formed between the pump actuator and the bayonette guide for holding a residual fluid;

a fluid passageway between the bore and the draw back chamber;

a pump motor for moving the pump actuator to said first position to actuate the pump mechanism and propel a dose of the fluid through said bore and into said dispensing tube and to collapse the draw back chamber to propel the residual fluid through said fluid passageway into said bore;

said pump actuator moving to said second position to expand said draw back chamber and draw the fluid from the dispensing tube into the draw back chamber.

2. The dispensing system of claim 1 wherein said dispensing tube is located in a spout.

3. The dispensing system of claim 2 wherein said dispensing tube, said spout and said container are coaxial.

4. The dispensing system of claim 1 wherein the dispensing tube, pump mechanism and draw back chamber are coaxial.

5. The dispensing system of claim 1 wherein said dispensing tube is connected to said pump actuator for movement with said pump actuator.

6. The dispensing system of claim 1 wherein the draw back chamber surrounds said bore.

7. The dispensing system of claim 1 wherein said draw back chamber is defined in part by a seal.

8. The dispensing system of claim 1 wherein a spring biases said pump actuator to said second position.

9. The dispensing system of claim 8 wherein said spring is located in said draw back chamber.

10. The dispensing system of claim 1 wherein said draw back chamber is defined in part by a seal and a spring located in said draw back chamber exerts a force against said seal to bias said pump actuator to said second position.

11. The dispensing system of claim 1 wherein the pump mechanism includes a nozzle insert that is received in said bore.

12. The dispensing system of claim 1 wherein said pump motor moves a pump hammer that engages the pump actuator to drive the pump actuator to said first position and said pump mechanism includes a nozzle insert that is received in said bore, said pump actuator drives the bayonette guide to push the nozzle insert.

13. The dispensing system of claim 8 wherein when said draw back chamber collapses said spring is compressed.

14. The dispensing system of claim 1 wherein fluid propelled through said fluid passageway into said bore is dispensed with said dose of fluid through the dispensing tube.

15. The dispensing system of claim 1 wherein a spring in the pump mechanism biases the bayonette guide to follow said pump actuator as it moves to said second position.

16. The dispensing system of claim 1 wherein as the draw back chamber expands a vacuum effect is created in the dispensing tube to prevent fluid from dripping from the dispensing tube.

17. The dispensing system of claim 16 wherein the vacuum effect is created through said fluid passageway.

18. The dispensing system of claim 1 wherein said fluid is a soap.

19. A method of dispensing a fluid comprising:

providing a dispensing tube for receiving a fluid from a container, a pump actuator connected to the container and having a bore extending through said pump actuator in fluid communication with said dispensing tube and a draw back chamber in fluid communication with said bore for holding a residual fluid;

moving the pump actuator to a first position to propel a dose of the fluid from said container through said bore and into said dispensing tube and to simultaneously collapse the draw back chamber;

moving the pump actuator to a second position allowing said draw back chamber to expand and draw the fluid from the dispensing tube into the draw back chamber.

20. The method of claim 19 wherein as said draw back chamber collapses fluid in said draw back chamber is dispensed with said dose of fluid.

21. A dispensing system for dispensing a fluid comprising:

a dispensing tube;

a pump mechanism for delivering a fluid from a container;

a body defining an interior cavity connected to the container for movement between a first position and a second position and defining an opening for receiving the dispensing tube;

a guide mounted for movement with said body and defining a bore extending through said guide to allow passage of the fluid from the pump mechanism to said dispensing tube, said guide located in said interior cavity to define a draw back chamber between the body and the guide for holding a residual fluid, and a seal located between the body and the guide to close the draw back chamber;

a fluid passageway between the bore and the draw back chamber;

a pump motor for moving the body to said first position to actuate the pump mechanism and propel a dose of the fluid through said bore and into said dispensing tube and to move the body and guide relative to the seal to collapse the draw back chamber to propel the residual fluid through said fluid passageway into said bore;

said body and guide moving to said second position to expand said draw back chamber and draw the fluid from the dispensing tube into the draw back chamber.

22. A dispensing system for dispensing a fluid comprising:

a dispensing tube;

a pump mechanism for delivering a fluid from a container;

a pump actuator having a body defining an interior cavity connected to the container for movement between a first position and a second position and defining an opening for receiving the dispensing tube such that the dispensing tube moves with said pump actuator;

a guide mounted for movement with said body and defining a bore extending through said guide between the container and the opening to allow passage of the fluid from the pump mechanism to said dispensing tube, said guide located in said interior cavity to define a draw back chamber between the body and the guide for holding a residual fluid, and a seal extending between the body and the guide to close the draw back chamber;

a fluid passageway between the bore and the draw back chamber;

a pump motor for moving the body and guide to said first position to actuate the pump mechanism and propel a dose of the fluid through said bore and into said dispensing tube and to simultaneously move the body and guide relative to the seal to collapse the draw back chamber to propel the residual fluid through said fluid passageway into said bore;

said body and guide moving to said second position to expand said draw back chamber and draw the fluid from the dispensing tube, though the guide and into the draw back chamber.

* * * * *